United States Patent [19]

Mauer

[11] Patent Number: 4,984,441

[45] Date of Patent: Jan. 15, 1991

[54] ELECTRICALLY CONTROLLED BOLT LOCK

[75] Inventor: Guenter Mauer, Heiligenhaus, Fed. Rep. of Germany

[73] Assignee: Mauer GmbH, Heiligenhaus, Fed. Rep. of Germany

[21] Appl. No.: 387,654

[22] Filed: Jul. 31, 1989

[30] Foreign Application Priority Data

Aug. 2, 1988 [EP] European Pat. Off. ..... 88112519

[51] Int. Cl.[5] ..... E05B 47/00

[52] U.S. Cl. ..... 70/277; 70/278

[58] Field of Search ..... 70/277, 278; 292/45, 292/201

[56] References Cited

U.S. PATENT DOCUMENTS 4,656,852 4/1987 Deschamps ..... 70/277

4,807,455 2/1989 Mauer ..... 70/277

FOREIGN PATENT DOCUMENTS 3209751 9/1983 Fed. Rep. of Germany ..... 70/277

*Primary Examiner*—Robert L. Wolfe

*Attorney, Agent, or Firm*—Ralf H. Siegemund

[57] ABSTRACT

An electrically controlled bolt lock with a control plate which is positively connected to a bolt element there also being a tumbler or the lock is improved by a first pin extending from the control plate for engagement with the tumbler; a second pin is also mounted on the control plate; a spring biased armature lever is pivotably mounted to the tumbler and is operated by the second pin engaging an armature is pivoted on the armature lever cooperating with a stationary electromagnet and the second pin pivoting said armature lever whenever said electromagnet holds the armature on energization of the electromagnet to thereby place said tumbler into a release position.

5 Claims, 3 Drawing Sheets

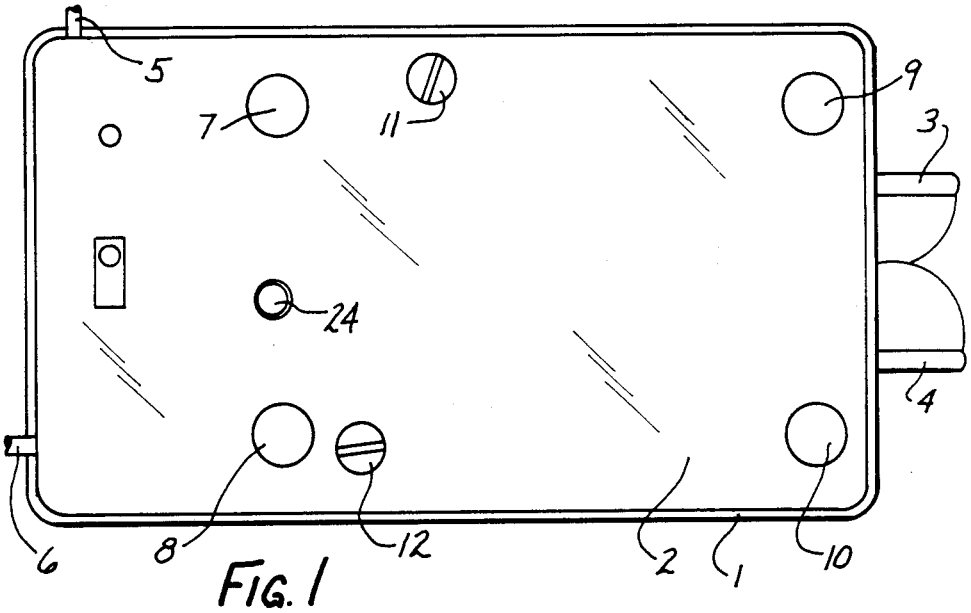
FIG. 1
FIG. 2
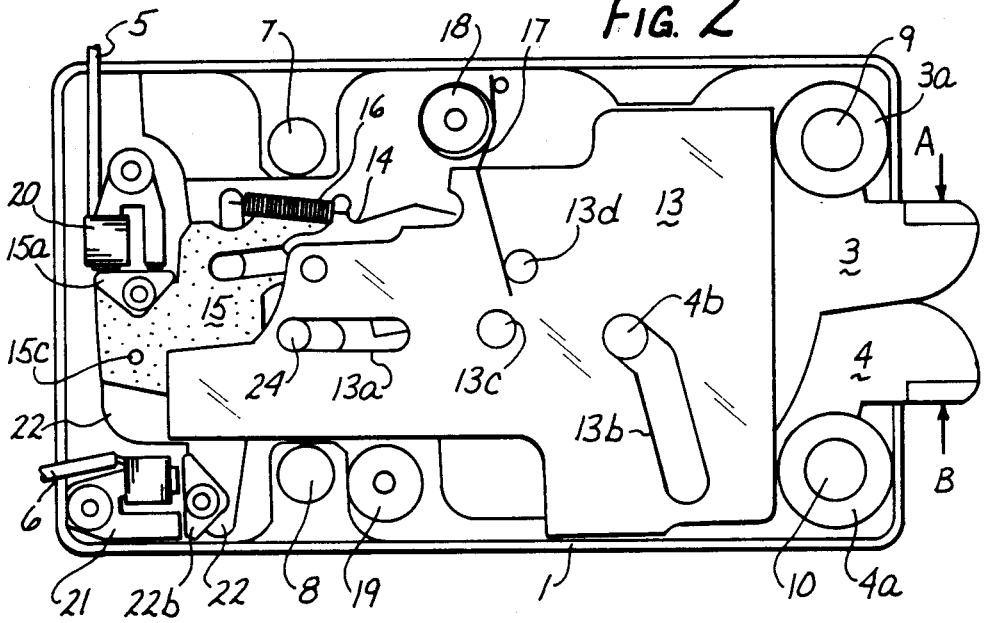

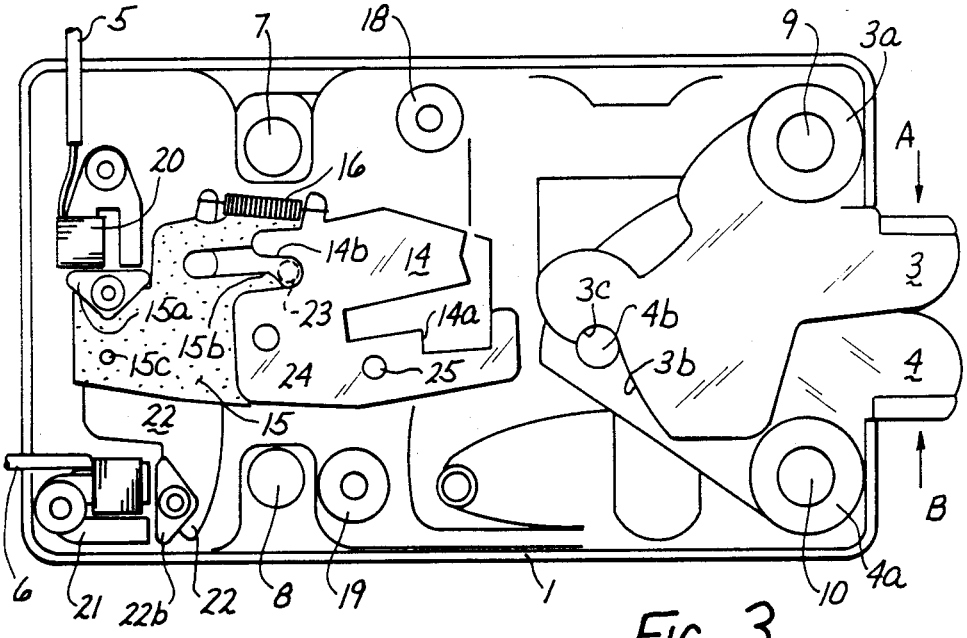
FIG. 3
FIG. 4
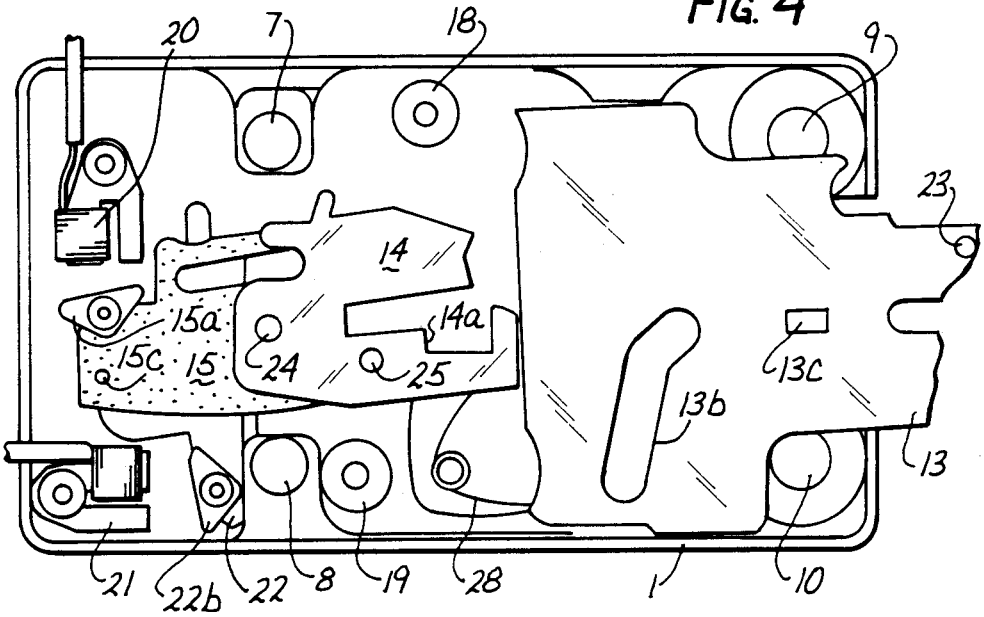

FIG. 5
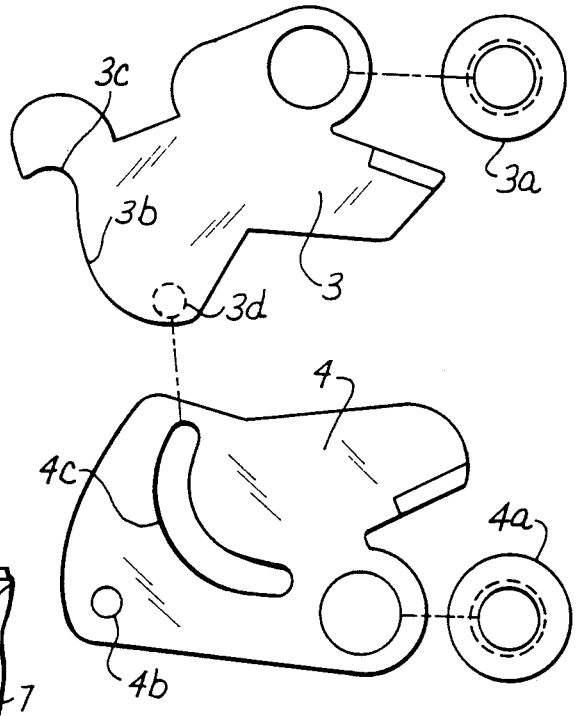
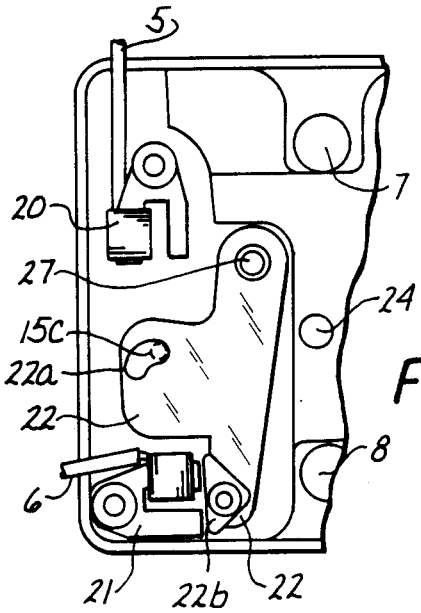
FIG. 6
FIG. 7
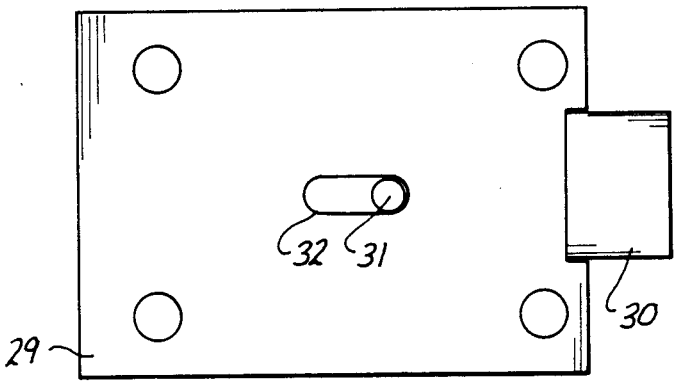

ELECTRICALLY CONTROLLED BOLT LOCK

BACKGROUND OF THE INVENTION

The present invention relates to an electrically controlled latch or bolt lock including a control element that is connected to the key bolt for permitting the transfer of force. The lock is to be usable for a central lock arrangement as well as for deadbolt and safety locks.

Central locks and lock structures are used in heavy doors on vaults wherein strong bolts are provided along all four edges of the door, and they are moved (driven) into the frame. For this it is usual to use four flat steel rods arranged in a crosslike pattern and to drive them for purposes of moving these bolts through a hand wheel and gears. For locking the bolts one needs at least two flat bars which on one hand move opposite to each other but partially cover each other in a superimposed relationship whereby these flat rods have overlapping cutouts or slots. They overlap particularly in the locking position so that a key bolt of a control lock can be inserted and prevent further movement of the two rods, so that the main bolt cannot be retracted into the door. There may be additional cut-outs in these rods for adding e.g. a second control lock or a time operated control lock or both. On the other hand for small safe deposit boxes one usually uses safety lock which is configured as a twin bit lock.

DESCRIPTION OF THE INVENTION

It is an object of the present invention to provide a new and improved supplemental bolt lock or control lock which can be controlled electrically and is usable in extensive bolt constructions for bolts and for simple safety locks. This bolt lock may either be centrally controlled particularly for release or operated through an encoding circuit. Central release really is preferred because of safety against unauthorized opening e.g. through force hand over of relevant keys.

In accordance with the preferred embodiment of the present invention, the control member is provided with a pin engaging a tumbler or bolt keeper and that the control member is provided with another control pin which engages a control surface of an anchor lever which armature lever is connected through a mandrel and a spring to the tumbler that an electromagnet faces the armature and the control pin on energized electromagnet pivots the armature lever about the armature itself which is held in position and thereby presses the tumbler in a release position. In a particular embodiment for the bolt lock a casing is provided for the lock which is placed upon an approximately similar size case of a safety lock preferably of the twin bit variety mentioned above particularly a twin bit tumbler lock. The fastening of the two locks is simple in that the fastening hold of the two casings should be aligned. The bolt of the safety lock should be provided with a pin as it is used for controlling the breakdown frames and swivels. This particular pin engages the control member of the bolt lock tending to push it into the final or particular end position. That however can be accomplished successfully only when the electromagnet is energized.

Hence, the bolt of the safety lock can be retracted only on coincidence of a particular electrical opening control pass and when the properly encoded key is inserted.

In a different embodiment of the invention, the control member is connected with two pivot or tilt bolt halves engaging in cut outs of a central bolt mechanism and releases same or locks it. Also, here the force for energizing the control issues from the bolt mechanism and the electromagnet is provided only to exert a holding function.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 illustrates the back view of a bolt lock in accordance with the preferred embodiment of the present invention for practicing the best mode thereof;

FIG. 2 illustrates the same lock shown in FIG. 1 but with cover removed;

FIG. 3 shows the device of FIGS. 1 and 2 but now following removal of the control member thereof to permit viewing the parts underneath;

FIG. 4 shows the same device of the preceding figures but the control member is shown in a reverse position (i.e. what is shown to be in the left in FIG. 2 is now shown to be right and on the other side);

FIG. 5 illustrates split tilt bolts as used in the bolt lock of FIGS. 1–4;

FIG. 6 illustrates a portion view of FIG. 4 with components removed; and FIG. 7 shows a safety lock with operating pin for connection to a lock of the kind shown in FIGS. 1–6.

Proceeding now to the detailed description of the drawings, FIG. 1 illustrates a housing or case 1 having a rear wall 2 and showing also, projecting from one side, the two portions of a split pivot or tilt bolt, the two portions being identified by reference numeral 3,4. The left hand side of the housing or case 1 shows the end connections of cable 5 and 6. The bolt lock is fastened through cut-outs 7,8,9,10, being appropriate bores, for purposes of bolting e.g. this lock casing to the casing or operating plate of a central bolt and locking mechanism e.g. for a vault door. Screws with slotted heads 11,12 are provided to connect the rear wall with the casing 1. Reference numeral 24 refers to a mandrel or pin mounted to the housing (e.g. its front wall) simply for enhancing stability of the positioning of the back or rear wall 2.

FIG. 2 now shows the wall 2 removed and one can see various elements included in casing 1. One can see particularly that the two portions 3 or 4 of the tilting bolt, are partially covered by a control plate 13. The left hand, smaller or narrower part of the plate 13 is provided with a guide slot or control slit **13*a* through which penetrates the casing pin 24. This pin 24*a* projects, as was explained above, through an opening in the rear cover 2. The movement of control element 13 is therefore constrained by this combination of pin 24 and control slit 13*a*. The right hand, and wider or larger portion of the plate 13 is provided with a particularly contoured control slit 13*b*. A control pin 4*b* runs in slit 13*b* and pin 4*b* itself is mounted to one of the pivot portions 4, as shown specifically in FIG. 3**.

In addition, the pin **4*b* runs on a control curve 3*b* that pertains to the other bolt portion, 3**. However, as can be seen from FIG. 5, a pin 3*d* or 3 runs in slot 4*c* of portion 4 of the split bolt. FIG. 3 shows pin 4*b* in a cut out or end portion 3*a* of the control curve 3*b*. The two bolt portions 3 and 4 are pivotally mounted, in case, through the utilization of sleeves 3*a* and 4*a*.

Upon exerting a force, or better, forces as indicated by arrows A and B, upon the bolt parts 3 and 4, the control pin 4*b* moves to the left and down (in FIG. 3) and thereby shifts the control plate 13 to the left relative to the position that is shown in FIG. 2. A spring 17 acts on a pin 13*d* and causes the control plate 13 to be moved back (to the right) and into the resting position as shown in FIG. 2 when there are no other forces which overcome the force of the spring 17. Spring 17 is partially looped around a threaded post 18. Another threaded post is shown by 19.

The most important component of control plate 13 is a downwardly extending pin 13*c* of which FIG. 2 shows just the rivet head on and in member 13. The pin 13*c* projects down, as far as the plane of the drawing of FIG. 2 and the direction of viewing is concerned. Another important element for the overall function of the lock is a control pin 23 which also extends down and into the case, and it engages particularly a tumbler 14 and here an armature lever 15. The lever 15 is provided with a pivotable armature 15*a* facing a stationary electromagnet 20; the term stationary in the present context means that the electromagnet 20 is fixed in relation to the case 1. A second electromagnet 20 is fixed in relation to the case 1. A second electromagnet 21 operates an armature lever 22.

FIG. 3 illustrates the contours of the two tilt bolt portions as well as the contour of the tumbler 14 and of the armature lever 15. The two components 14 and 15 are pivotally interconnected through a mandrel or pin 25. The tumbler 14 is pivotally mounted for tilting about a pin 24 which in turn is fixed to the casing 1. A coil spring 16 interconnects the tumbler 14 and the armature lever 15 such that the armature 15*a* thereof is pulled against the electromagnet 20. A control curve of a tumbler 14 is identified by reference numeral 14*a*; that curve 14*a* is of a cutoutlike configuration in which moves the pin 13*c* introduced already with a reference to FIG. 2 and shown more particularly in FIG. 4. The tumbler is moreover provided with another control slot 14*b* positioned above a control curve 15*b*, being a portion of the armature lever 15. The control pin 23 mentioned above and as affixed to the control plate 13 engages these openings and slits 14*b* and 15*b*. This pin 23 extends down in FIG. 2 but up from the plane of the drawing in FIG. 4.

The elements and components 13,14,15 operate as follows. Whenever the control plate 13 is moved to the left by operation of control pin 4*b* for reasons mentioned above e.g. the control pin 23 runs against the oblique surface 15*b*. The electromagnet 20 is not energized and the armature lever 15 will be tilted, turned or pivoted counterclockwise as the spring 16 expands. The pivot axis specifically is the axis of the pin 25. Here then the tumbler 14 remains in the locking position as shown in FIG. 3 because the spring 16 exerts the momentum which is in the direction towards the left of the figure.

On the other hand if the armature 15*a* is held by the energized magnet 20 then the pin 23 forces the armature lever 15 down, clockwise around the armature 15*a*, whereby the pin 25 moves on a circle around the armature 15*a*. Consequently the tumbler 14 must move in clockwise direction around the pin 24 and therefore is expected to assume the release position. In this case then spring 16 is expanded.

The control plate 13 can be moved further to the left so that the split bolt portions 3 and 4 each are pivoted into the house 1 and therefore unlock whatever they unlock. When the bolts of that latter lock (not shown) are supposed to be again put into locking position then the two split bolt portions 3 and 4 fall back into the cutouts and the control plate 13 returns to the normal position while the tumbler 14 assumes or, better, resumes its locking position. In this case the lock can be open only with the magnet 20 is energized.

The cooperation of the parts 13,14,15 provides mechanically for calling on the energizing state of the magnet. The coils of that magnet therefore in effect provide a holding force only, when the air gap is zero (FIGS. 2,3) and in that case the holding force needed is very low. Consequently the energizing power of the magnet 20 and therefore its dimensions are considerably smaller than were needed in the case of lifting magnets which have been used in locks in the past.

FIG. 5 illustrates specifically the contour of the two split bolts 3 and 4 and portions also the bearing and mounting sleeves for them, 3*a* and 4*a* respectively. Two strong fastening screws (not shown) reach through the sleeves and therefore reenforce the bearing function of the tiltable bolt elements.

FIG. 6 illustrates the left hand portion in view when the armature is removed, simply for facilitating inspection; making the bottom of the casing visible. One can see that a second armature 22 is mounted to that bottom by means of a pin 27. An armature lever 22 has a hook shaped control curve 22*a*. The pin 15*c* as shown in FIG. 4 engages that control curve 22*a*. Another electromagnet 21 is provided and it faces an armature 22*b* pivotably mounted on lever 22. When neither of the magnets 20 and 21 are energized then the pins 15*c* of the armature 15 forces the armature lever 22 to the right under cooperation of the control curve 22*a* so that the armature 22*b* lifts off the magnet 21 and the lock remains blocked.

If the electromagnet 21 is energized and attracts and holds the armature 22*b* the lever 22 can not escape under pressure of the pin 15*c*. This means that in that case armature lever 15 is held in position. The situation is thus quite the same as if magnet 20 were energized. Therefore if electromagnet 20 for some reason fails because there is a defect in the control circuit or in the conductors or whatever, there is now established a safety or emergency override feature for dealing with this situation and permitting opening of the lock. In such an emergency situation magnet 21 is activated in order to open the safety box, vault or the like. Owing to this particular redundancy feature one may with certainty and safety open the particular vault, safety box etc. in emergency cases such as an alarm situation when there is fire, high flood water or any other catastrophy. This is also true even if the first electric current for the magnet 21 actually pertains to a time lock.

FIG. 7 illustrates by way of comparison the contour and outlining of a conventional safety lock 29 from the rear. The lock has a bolt 30 which carries a pin 31. Details of the structure are not relevant, it is important only, that pin 31 can be coupled with the control plate 13. This way the old lock is modified or retrofitted such that the bolt 30 can be pulled back by means of a key only when, there is also present an electrical release signal. An oblong slot 32 in the lock housing permits sliding of the pin 31 and is dimensioned so that the bolt 30 can in fact undergo a regular stroke. On the other hand if the bolt lock described in reference to FIGS. 1–6 without pivoting bolt elements and instead modifies the control plate 13 by giving it a slot which the pin 31 can engage, then one obtains through the connection for two locks, through their houses to obtain a particular safety deposit lock with an electrically controlled bolt block.

The combination of two locks, one being the safety lock proper and the other one locking the bolt of the former in an electrical fashion, is extremely interesting for use in safety deposit boxes of bank vaults of various sizes and kinds. The authorized user uses his key and the attendant turns on the electric current for the electromagnet in order to obtain a release of the lock as soon as he is certain about the identity of the person demanding access to the vault or box.

There are a variety of very important features included in the construction outlined above which have to do with the economics of producing the invention. First of all as outlined above the only small magnets with a minimum stroke are required so that the power consumption is very low. Any movement of the bolt lock and of the components therein is obtained by forces exerted upon the elements from the outside such as bolt lock operating rods or the like. Here reference is made to the introduction concerning the conventional actuating mechanisms for the vault locks including particularly the rods mentioned above which are running in opposite directions for both locking and release. Here and in the present case the physical movement is translated, so to speak, into a spring force (spring 28, FIG. 4) that may be provided so that the locking elements 3 and 4 can fall back to assume the locking position.

The bolt lock should cover the area that is not larger than the usual twin bit lock or conventional combination locks. Thus any of the latter can be removed and replaced by the inventive bolt lock. The tumbler elements can be of a rather flat construction. It is also important that the vault door e.g. does not have to be provided with any openings. The control lines and electric circuit lines can be well hidden and can pass through the vault or safety deposit box walls rather than door.

The invention is not limited to the embodiments described above but all changes and modifications thereof, not constituting departures from the spirit and scope of the invention, are intended to be included.

I claim:

1. Electrically controlled bolt lock with a control plate which is positively connected to a bolt element, there also being a tumbler or the lock, the improvement comprising:

a first pin extending from and connecting to said control plate for engagement with the tumbler;

a second pin mounted to and extending from said control plate;

a spring biased armature lever pivotably mounted to said tumbler and having a control surface, said second pin engaging and operating said armature lever;

an armature on said armature lever;

a stationary electromagnet magnetically coupled to said armature; and said second pin pivoting said armature lever whenever said electromagnet holds said armature on energization of the electromagnet to thereby place said tumbler into a release position.

2. Bolt lock in accordance with claim 1 and in combination with a casing of a safety lock having a bolt which carries a third pin, the casing of said bolt lock configured so that upon particularly connecting to the casing of the safety lock said third pin engages and operates said control plate.

3. Bolt lock as in claim 1 including two pivotable bolt elements one element having a control pin engaging the other element and a control curve of said control plate to hold both elements in a protracting locking position while permitting retraction when the control plate is not held.

4. Bolt lock as in claim 1, said armature being biased by means of a relatively week spring with force sufficient to urge the armature against said electromagnet of a force equivalent to the holding force provided by the electromagnet.

5. Bolt lock as in claim 1, including emergency equipment that includes a second electromagnet, a second armature, a second armature lever for mounting said second armature having a hook shaped control curve there being a control pin extending from the first mentioned armature to cause the lever 22 to pivot and to follow the motion whenever the second magnet is not energized.

* * * * *